US009107498B1

(12) United States Patent
Wooten

(10) Patent No.: US 9,107,498 B1
(45) Date of Patent: Aug. 18, 2015

(54) WEAPON SUPPORT ASSEMBLY

(71) Applicant: Edgar W. Wooten, Estill, SC (US)

(72) Inventor: Edgar W. Wooten, Estill, SC (US)

( * ) Notice: Subject to any disclaimer, the term of this patent is extended or adjusted under 35 U.S.C. 154(b) by 84 days.

(21) Appl. No.: 13/761,308

(22) Filed: Feb. 7, 2013

(51) Int. Cl.
*F16L 3/00* (2006.01)
*A47B 81/00* (2006.01)
*F41A 23/18* (2006.01)

(52) U.S. Cl.
CPC ..... *A47B 81/00* (2013.01); *A47B 81/005* (2013.01); *F41A 23/18* (2013.01)

(58) Field of Classification Search
CPC ..... A47B 81/00; A47B 81/005; F41A 23/18
USPC ..... 248/156; 211/64; 42/94; D06/552
See application file for complete search history.

(56) References Cited

U.S. PATENT DOCUMENTS 3,007,581 A 11/1961 Moore
3,576,084 A * 4/1971 Anderson, Jr. ..... 42/94
3,952,878 A 4/1976 Gorham
4,144,971 A * 3/1979 Balibrea ..... 211/64
4,846,140 A 7/1989 DiMartino
5,329,710 A * 7/1994 Huddleston ..... 38/104
5,626,379 A 5/1997 Scott
5,680,939 A 10/1997 Oliver
5,819,462 A 10/1998 Dockery
6,198,624 B1 * 3/2001 Margaritis ..... 361/679.05
6,749,170 B1 6/2004 Rhoads
6,935,065 B1 8/2005 Oliver
7,314,199 B1 1/2008 Ward
D604,077 S * 11/2009 Cardenas ..... D6/552

* cited by examiner

*Primary Examiner* — Monica Millner

(57) ABSTRACT

A weapon support assembly holds a weapon such as a rifle, shotgun or bow in a temporary hunting structure while not actively hunting. The assembly includes a shaft having a first end and a second end. Legs are coupled to and extend from the shaft to support the shaft in an upright position on a supporting surface. Each of the legs is positioned proximate the first end of the shaft. A foot plate is coupled to and extends from the shaft. A weapon support is coupled to and extends from the shaft proximate the second end of the shaft. A handle is coupled to and extends from the shaft proximate the second end of the shaft. A holding member is also coupled to the shaft for holding an item such as a beverage container.

10 Claims, 5 Drawing Sheets

WEAPON SUPPORT ASSEMBLY

BACKGROUND OF THE DISCLOSURE

Field of the Disclosure

The disclosure relates to weapon support devices and more particularly pertains to a new weapon support device for holding a weapon such as a rifle, shotgun or bow in a temporary hunting structure while not actively hunting.

SUMMARY OF THE DISCLOSURE

An embodiment of the disclosure meets the needs presented above by generally comprising a shaft having a first end and a second end. Legs are coupled to and extend from the shaft to support the shaft in an upright position on a supporting surface. Each of the legs is positioned proximate the first end of the shaft. A foot plate is coupled to and extends from the shaft. A weapon support is coupled to and extends from the shaft proximate the second end of the shaft. A handle is coupled to and extends from the shaft proximate the second end of the shaft. A holding member is also coupled to the shaft for holding an item such as a beverage container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
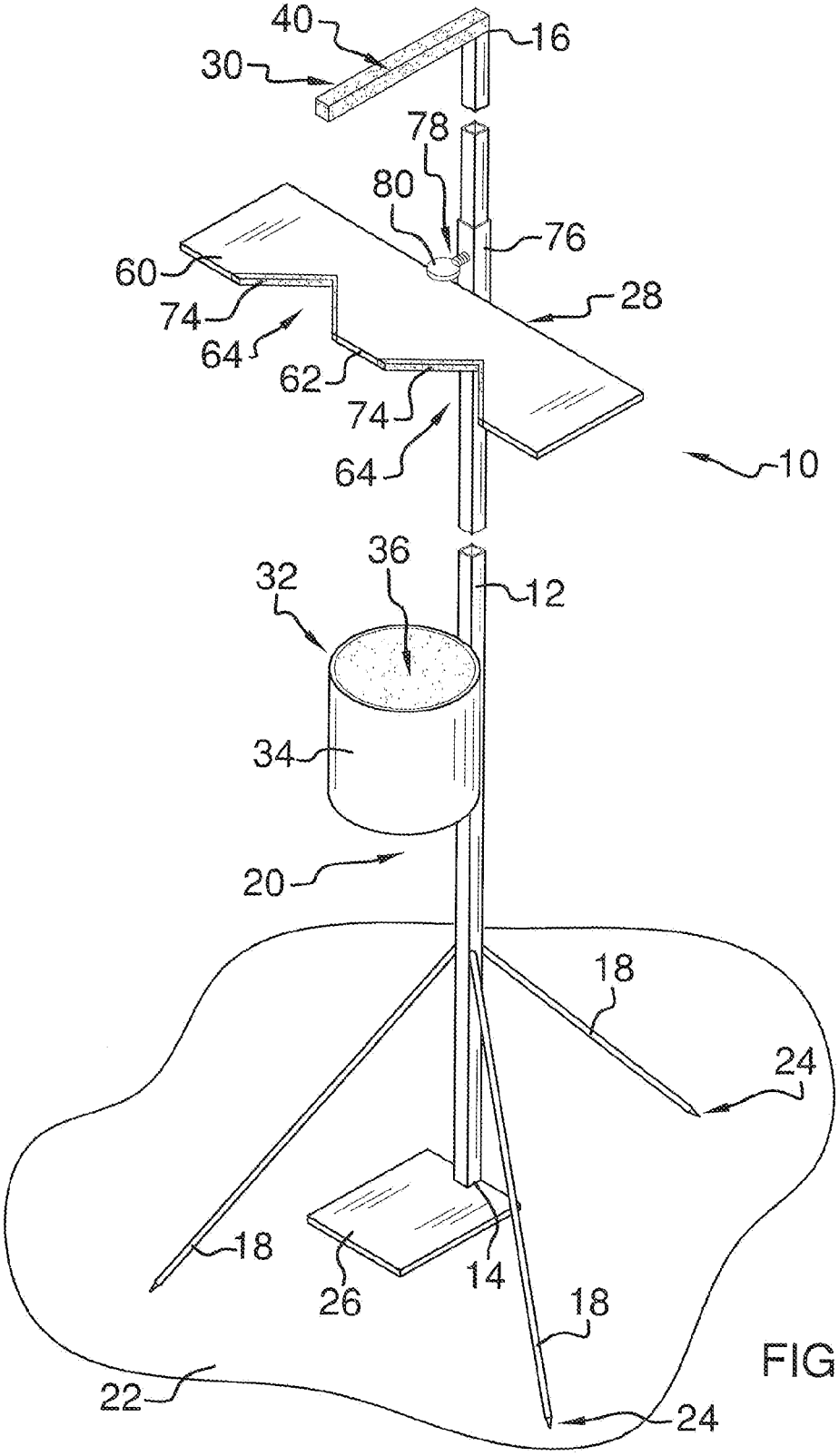
FIG. 1 is a top front side perspective view of a weapon support assembly according to an embodiment of the disclosure for holding a firearm.

With reference now to the drawings, and in particular to FIGS. 1 through 6 thereof, a new weapon support device embodying the principles and concepts of an embodiment of the disclosure and generally designated by the reference numeral 10 will be described.

As best illustrated in FIGS. 1 through 6, the weapon support assembly 10 generally comprises a shaft 12 having a first end 14 and a second end 16. A plurality of legs 18 is coupled to and extends from the shaft 12. The legs 18 are configured to support the shaft 12 in a substantially upright position 20 on a supporting surface 22. There may be exactly three legs 18 with each of the legs 18 being positioned proximate the first end 14 of the shaft 12. A distal end 24 of each of the legs 18 relative to the shaft 12 is pointed to facilitate insertion of each distal end 24 into a ground surface to secure the positioning of the shaft assembly 10. Each leg 18 extends from the shaft 12 angled downward and the distal ends 24 of the legs 18 are positioned in a plane in spaced relationship to the first end 14 of the shaft 12 to prevent the first end 14 of the shaft 12 from contacting the supporting surface 22. A rearwardly extending one of the legs 18 may be longer than the other legs 18. A foot plate 26 is coupled to and extends from the shaft 12. The foot plate 26 extends transversely from the first end 14 of the shaft 12. A weapon support 28 is coupled to and extends from the shaft 12 in spaced relationship to the foot plate 26 proximate the second end 16 of the shaft 12.

A handle 30 is coupled to and extends from the shaft 12 proximate or at the second end 16 of the shaft 12. The handle 30 extends transversely from the second end 16 of the shaft 12 to facilitate moving the assembly 10 when desired. An outer surface 40 of the handle 30 may be constructed of a resilient material such as rubber or the like to facilitate gripping of the handle 30.

A holding member 32 is also coupled to the shaft 12. The holding member 32 has a perimeter wall 34 defining an open top 36 wherein the holding member 32 is configured for holding an item such as a drink container. A bottom of the holding member 32 may be open permitting frictional engagement of the perimeter wall 34 to hold the item or the bottom of the holding member may be either closed or partially closed providing a surface upon which the item may rest while the perimeter wall 34 inhibits lateral movement of the item.

Figure 2:
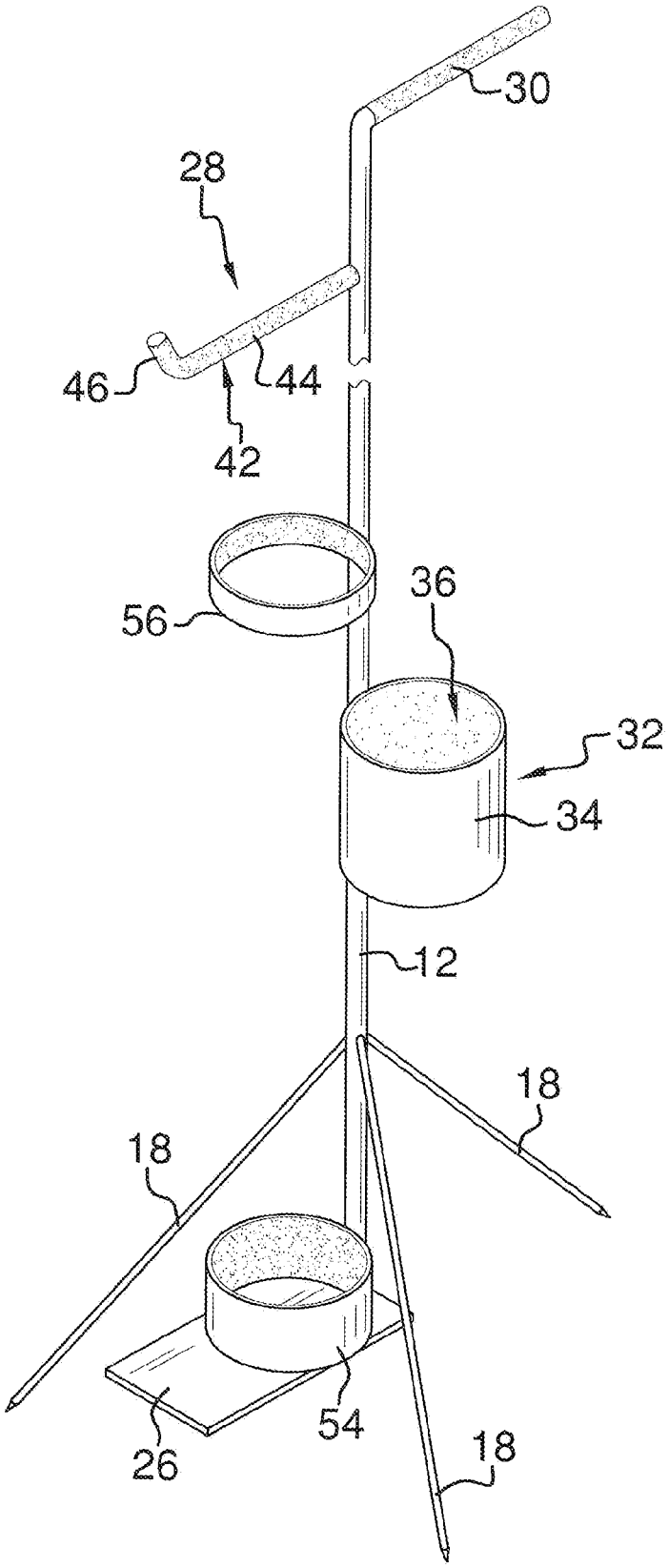
FIG. 2 is a top front side perspective view of an embodiment of the disclosure for holding a bow and arrows.
Figure 4:
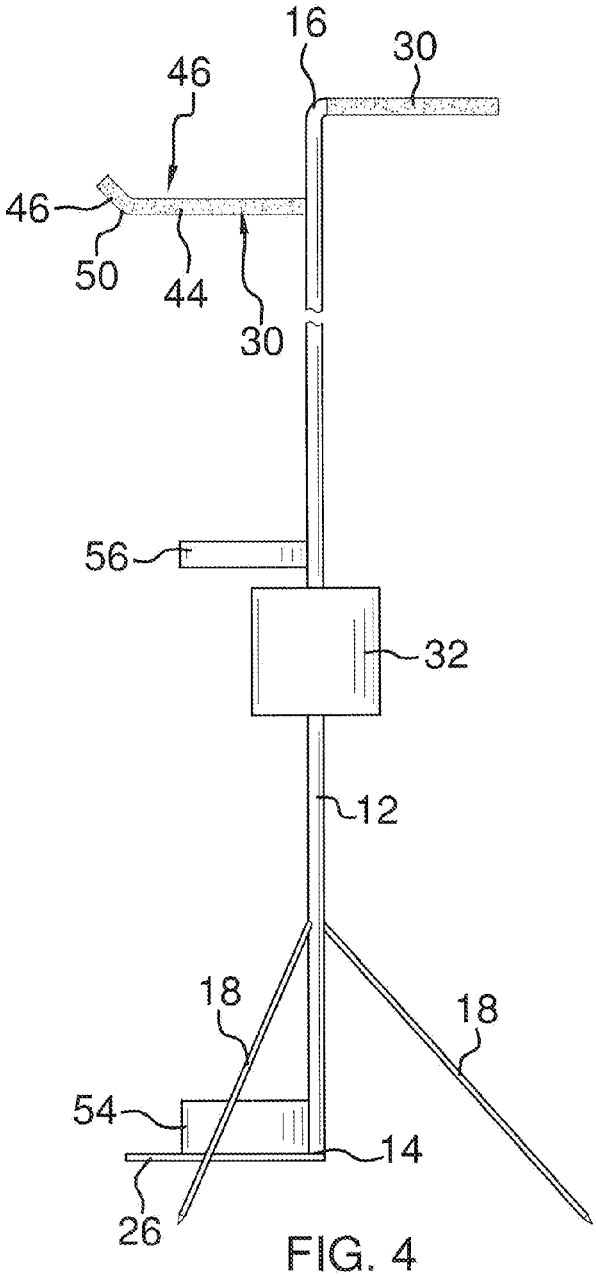
FIG. 4 is a side view of an embodiment of the disclosure.
Figure 6:
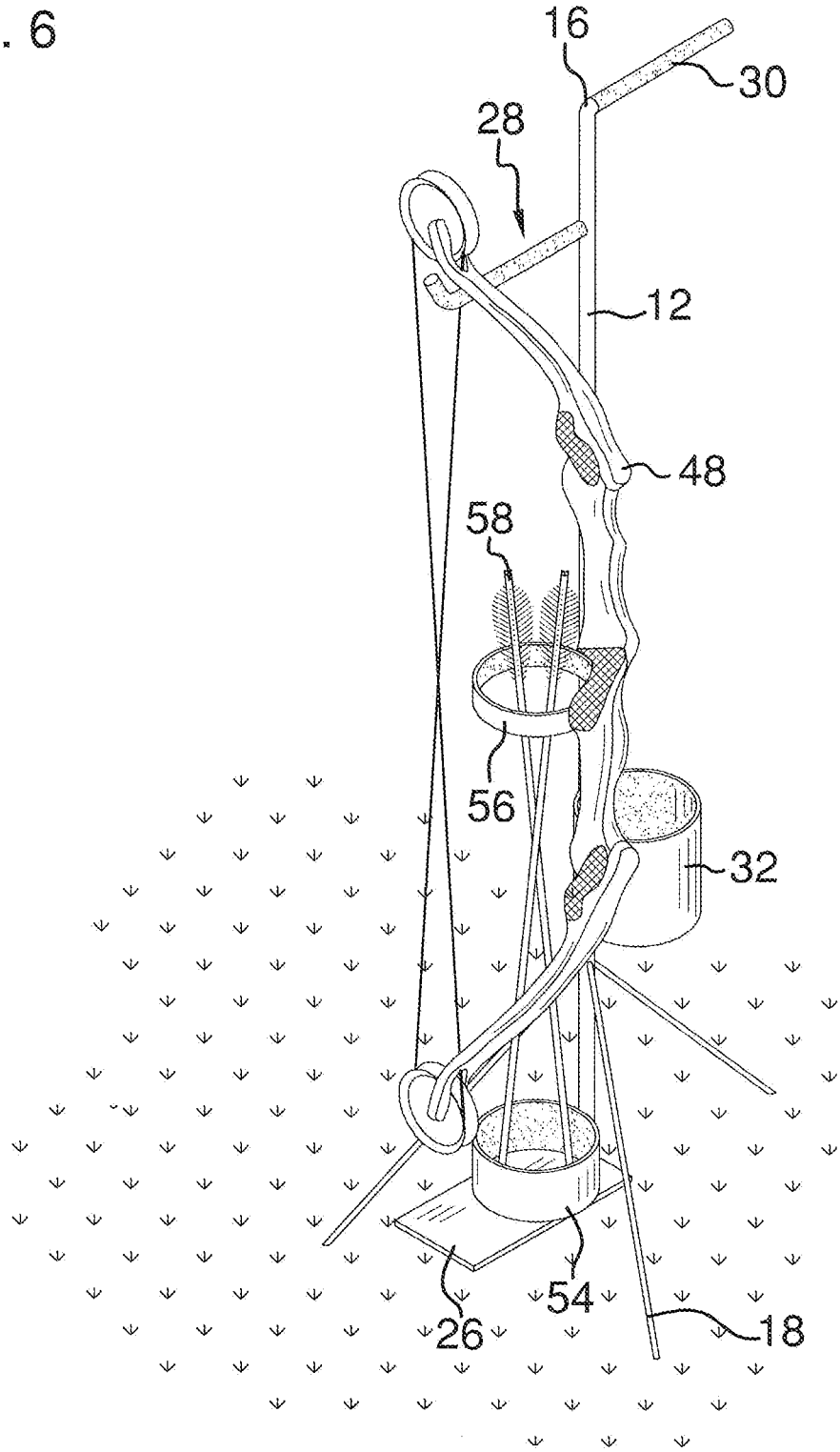
FIG. 6 is a top front side perspective view of an embodiment of the disclosure in use.

The weapon support 28 may configured to support a bow 48 by comprising an elongated arm 42 having a first section 44 and a second section 46 as shown in FIGS. 2, 4, and 6. The first section 44 is coupled to and extends substantially transversely from the shaft 12. The second section 46 extends from a distal end 50 of the first section 44 relative to the shaft 12. The second section 46 extends away from the shaft 12 and substantially towards the second end 16 of the shaft 12. Thus, the second section 46 is angle relative to the first section 44 and configured to prevent the bow 48 from sliding off of the arm 42. An outer surface 52 of the arm 42 is constructed of a resilient protective material wherein the weapon support 28 is configured to inhibit damage to the bow 48 contacting the arm 42. A pair of aligned spaced rings 54,56 may be provided as shown in FIGS. 2, 4, and 6. The rings 54,56 are coupled to and extend from the shaft 12. A lower one of the rings 54 is positioned over the foot plate 26 wherein the rings 54,56 are configured for receiving therethrough and supporting at least one arrow 58 when the arrow 58 is inserted through the rings 54,56 and supported on the foot plate 26. Each of the rings 54,56 may be lined with a protective material wherein the rings 54,56 are configured to inhibit damage to the arrow 58 when the arrow 58 is inserted through the rings 54,56 and supported on the foot plate 26. The lower one of the rings 54 may also employ a closed bottom suitable to support the arrow 58.

Figure 3:
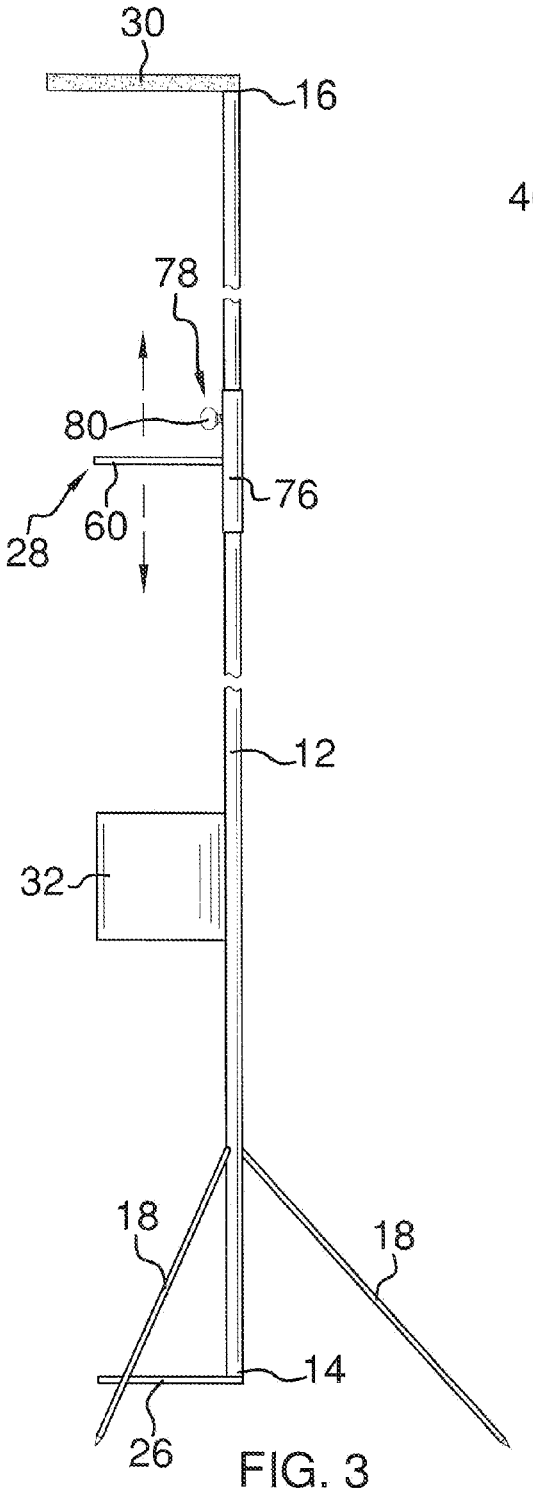
FIG. 3 is a side view of an embodiment of the disclosure.
Figure 5:
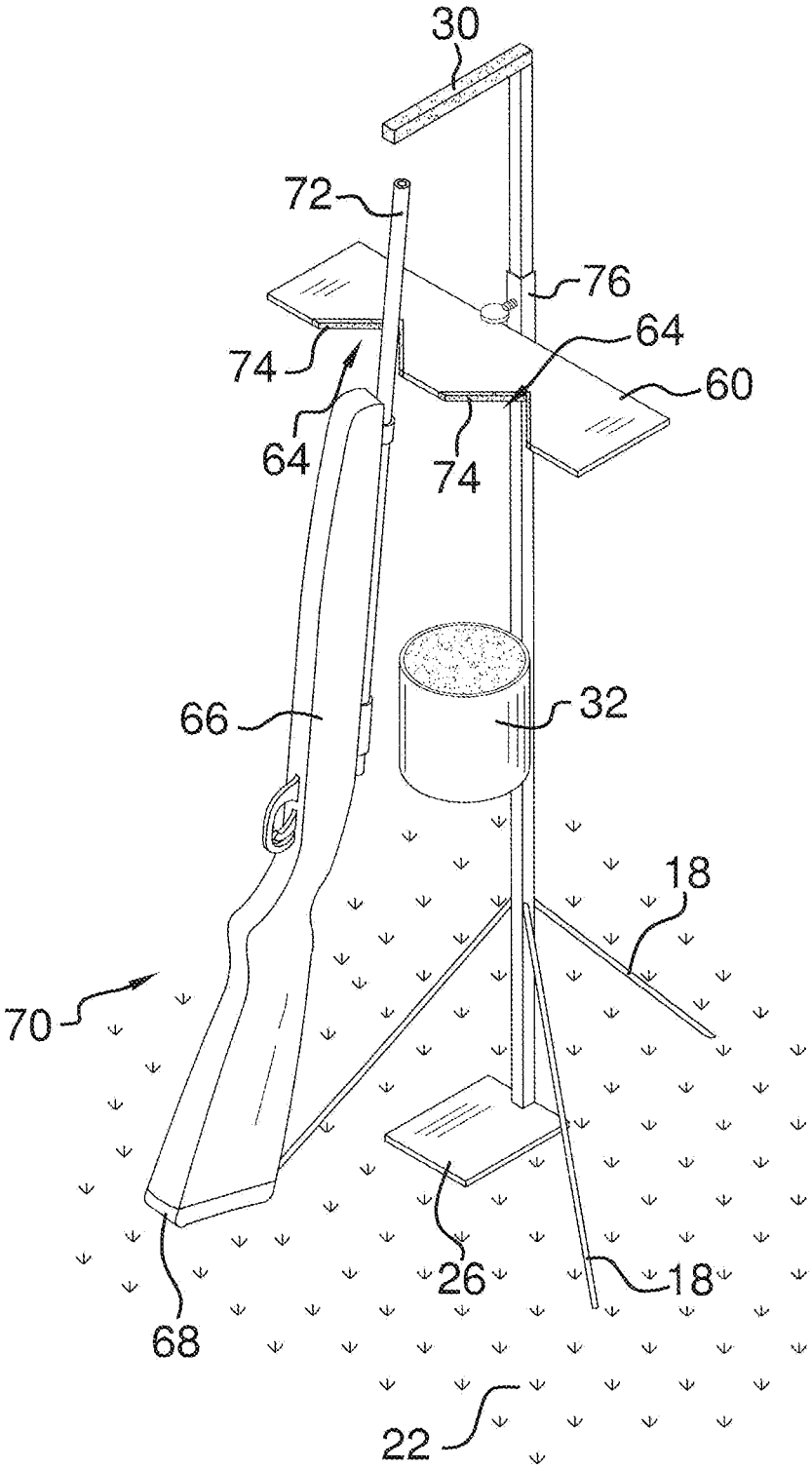
FIG. 5 is a top front side perspective view of an embodiment of the disclosure in use.

In the embodiment shown in FIGS. 1, 3, and 5, the weapon support 28 is configured to support a firearm 66 by comprising a planar member 60 having a distal edge 62 relative to the shaft 12. At least one notch 64 extends into the distal edge 62 of the planar member 60. Thus, the planar member 60 is configured to support the firearm 66 in a substantially upright position 70 when a barrel 72 of the firearm 66 is positioned in the notch 64. The planar member 60 may have exactly two notches 64 positioned in the distal edge 62 of the planar member 60. An edge 74 of the planar member 60 defining each notch 64 may be lined by a protective material wherein each notch 64 is configured to inhibit damage to the barrel 72 of the firearm 66 when the barrel 72 contacts the edge 74 of the planar member 60 defining the notch 64. A butt 68 of the firearm 66 may be positioned on the foot plate 26 or on the supporting surface 22 if so desired.

A collar 76 may be coupled to the weapon support 28 of either embodiment but is shown only if FIGS. 1, 3, and 5. The shaft 12 is slidably inserted through the collar 76. A locking member 78 is extendably coupled to the collar 76 wherein the locking member 78 selectively extends to engage the shaft 12 wherein the weapon support 28 is securable at a selectable position along a length of the shaft 12. The locking member 78 may be a thumbscrew 80. The shaft 12 may have a polygonal transverse cross-sectional shape to inhibit twisting of the collar 76 on the shaft 12.

In use, the assembly is positioned on the supporting surface 22. The desired weapon, either the bow 46 or the firearm 66, is positioned to be supported by the weapon support 28. The assembly 10 supports the weapon until the user is ready to handle the weapon. Thus, the assembly is configured to inhibit damage to the weapon while freeing the hands of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A weapon support assembly comprising:

a shaft having a first end and a second end;

a plurality of legs coupled to and extending from said shaft wherein said legs are configured to support said shaft in an upright position on a supporting surface, each of said legs being positioned proximate said first end of said shaft;

a foot plate coupled to and extending from said shaft;

a weapon support coupled to and extending from said shaft proximate said second end of said shaft, said weapon support comprising a planar member having a distal edge relative to said shaft, said distal edge being transversely oriented relative to said shaft; and at least one notch extending into said distal edge of said planar member wherein said planar member is configured to support a firearm in a substantially upright position when a barrel of the firearm is positioned in said notch;

a handle coupled to and extending from said shaft proximate said second end of said shaft; and a holding member coupled to said shaft, said holding member having a perimeter wall defining an open top wherein said holding member is configured for holding an item.

2. The assembly of claim 1, further comprising said foot plate extending transversely from said first end of said shaft.

3. The assembly of claim 1, further comprising said handle extending transversely from said second end of said shaft.

4. The assembly of claim 3, further comprising an outer surface of said handle being constructed of a resilient material.

5. The assembly of claim 1, further comprising:

a collar coupled to said weapon support, said shaft being slidably inserted through said collar; and a locking member extendably coupled to said collar wherein said locking member selectively engages said shaft wherein said weapon support is securable at a selectable position along a length of said shaft.

6. The assembly of claim 5, further comprising said locking member being a thumbscrew.

7. The assembly of claim 1, further comprising said planar member having exactly two said notches, each said notch extending into said distal edge of said planar member wherein said planar member is configured to support each of a pair of firearms in a substantially upright position when a barrel of the firearm is positioned in a respective one of said notches.

8. The assembly of claim 1, further comprising an edge of said planar member defining said notch being lined by a protective material wherein said notch is configured to inhibit damage to the barrel of the firearm when the barrel contacts said edge of said planar member defining said notch.

9. The assembly of claim 1, further comprising a distal end of each of said legs relative to said shaft being pointed.

10. A weapon support assembly comprising:

a shaft having a first end and a second end;

a plurality of legs coupled to and extending from said shaft wherein said legs are configured to support said shaft in an upright position on a supporting surface, each of said legs being positioned proximate said first end of said shaft, a distal end of each of said legs relative to said shaft being pointed;

a foot plate coupled to and extending from said shaft, said foot plate extending transversely from said first end of said shaft;

a weapon support coupled to and extending from said shaft proximate said second end of said shaft;

a handle coupled to and extending from said shaft proximate said second end of said shaft, said handle extending transversely from said second end of said shaft;

a holding member coupled to said shaft, said holding member having a perimeter wall defining an open top wherein said holding member is configured for holding an item;

an outer surface of said handle being constructed of a resilient material;

said weapon support comprising a planar member having a distal edge relative to said shaft;

a collar coupled to said weapon support, said shaft being slidably inserted through said collar;

a locking member extendably coupled to said collar wherein said locking member selectively engages said shaft wherein said weapon support is securable at a selectable position along a length of said shaft, said locking member being a thumbscrew;

exactly two notches, each said notch extending into said distal edge of said planar member wherein said planar member is configured to support each of a pair of firearms in a substantially upright position when a barrel of the firearm is positioned in a respective one of said notches; and an edge of said planar member defining said notch being lined by a protective material wherein said notch is configured to inhibit damage to the barrel of the firearm when the barrel contacts said edge of said planar member defining said notch.

* * * * *